US009103585B2

(12) United States Patent
Mak

(10) Patent No.: US 9,103,585 B2
(45) Date of Patent: Aug. 11, 2015

(54) CONFIGURATIONS AND METHODS FOR IMPROVED NATURAL GAS LIQUIDS RECOVERY

(75) Inventor: John Mak, Santa Ana, CA (US)

(73) Assignee: FLUOR TECHNOLOGIES CORPORATION, Aliso Viejo, CA (US)

( * ) Notice: Subject to any disclaimer, the term of this patent is extended or adjusted under 35 U.S.C. 154(b) by 1211 days.

(21) Appl. No.: 12/669,025

(22) PCT Filed: Aug. 13, 2008

(86) PCT No.: PCT/US2008/009736

§ 371 (c)(1),
(2), (4) Date: Jan. 22, 2010

(87) PCT Pub. No.: WO2009/023252

PCT Pub. Date: Feb. 19, 2009

(65) Prior Publication Data

US 2010/0206003 A1 Aug. 19, 2010

Related U.S. Application Data

(60) Provisional application No. 60/955,697, filed on Aug. 14, 2007.

(51) Int. Cl.

| | |
|---|---|
| ***F25J 3/00*** | (2006.01) |
| ***F25J 3/02*** | (2006.01) |
| ***C10G 5/06*** | (2006.01) |

(52) U.S. Cl.

CPC ..... *F25J 3/0209* (2013.01); *C10G 5/06* (2013.01); *F25J 3/0233* (2013.01); *F25J 3/0238* (2013.01); *F25J 3/0242* (2013.01); *C10G 2400/28* (2013.01); *F25J 2200/04* (2013.01); *F25J 2200/70* (2013.01); *F25J 2200/74* (2013.01); *F25J 2200/76* (2013.01); *F25J 2200/78* (2013.01); *F25J 2205/04* (2013.01); *F25J 2210/06* (2013.01); *F25J 2240/02* (2013.01);

(Continued)

(58) Field of Classification Search

CPC ..... F25J 3/0209; F25J 3/0233; F25J 3/0238; F25J 2200/70; F25J 2200/72; F25J 2200/74; F25J 2200/78; F25J 2200/76

USPC ..... 62/620, 630, 632, 657, 611, 613, 617, 62/618, 622

See application file for complete search history.

(56) References Cited

U.S. PATENT DOCUMENTS 4,278,457 A 7/1981 Campbell et al.
4,474,591 A * 10/1984 Arand et al. ..... 62/630

(Continued)

FOREIGN PATENT DOCUMENTS

WO 2004/065868 A2 8/2004
WO 2004/080936 A1 9/2004

(Continued)

*Primary Examiner* — John F Pettitt
*Assistant Examiner* — Webeshet Mengesha
(74) *Attorney, Agent, or Firm* — Fish & Tsang, LLP

(57) ABSTRACT

Contemplated plants for recovery of NGL from natural gas employ alternate reflux streams in a first column and a residue gas bypass stream, wherein expansion of various process streams provides substantially all of the refrigeration duty in the plant. Contemplated plants not only have flexible recovery of ethane between 2% and 90% while recovering at least 99% of propane, but also reduce and more typically eliminate the need for external refrigeration.

18 Claims, 1 Drawing Sheet

(52) U.S. Cl.
CPC ..... *F25J 2245/02* (2013.01); *F25J 2270/02* (2013.01); *F25J 2280/02* (2013.01)

(56) References Cited

U.S. PATENT DOCUMENTS

| | | | | |
|---|---|---|---|---|
| 4,854,955 | A | 8/1989 | Campbell et al. | |
| 5,685,170 | A * | 11/1997 | Sorensen | 62/625 |
| 5,771,712 | A * | 6/1998 | Campbell et al. | 62/621 |
| 5,890,377 | A | 4/1999 | Foglietta | |
| 5,890,378 | A | 4/1999 | Rambo | |
| 5,953,935 | A | 9/1999 | Sorensen | |
| 6,116,050 | A * | 9/2000 | Yao et al. | 62/630 |
| 6,244,070 | B1 | 6/2001 | Lee et al. | |
| 6,401,486 | B1 * | 6/2002 | Lee et al. | 62/630 |
| 6,712,880 | B2 * | 3/2004 | Foglietta et al. | 95/184 |
| 6,755,965 | B2 * | 6/2004 | Pironti et al. | 208/347 |
| 7,051,553 | B2 * | 5/2006 | Mak et al. | 62/636 |
| 7,216,507 | B2 * | 5/2007 | Cuellar et al. | 62/620 |
| 2004/0148964 | A1 * | 8/2004 | Patel et al. | 62/620 |
| 2004/0159122 | A1 * | 8/2004 | Patel et al. | 62/620 |
| 2004/0172967 | A1 * | 9/2004 | Patel et al. | 62/620 |
| 2004/0261452 | A1 | 12/2004 | Mak et al. | |
| 2005/0247078 | A1 * | 11/2005 | Wilkinson et al. | 62/612 |
| 2005/0268649 | A1 * | 12/2005 | Wilkinson et al. | 62/613 |
| 2006/0032269 | A1 * | 2/2006 | Cuellar et al. | 62/620 |
| 2006/0283207 | A1 * | 12/2006 | Pitman et al. | 62/620 |
| 2008/0271480 | A1 * | 11/2008 | Mak | 62/626 |

FOREIGN PATENT DOCUMENTS

| | | | |
|---|---|---|---|
| WO | 2007/001669 | A2 | 1/2007 |
| WO | 2007/014069 | A2 | 2/2007 |
| WO | 2007/014209 | A2 | 2/2007 |

* cited by examiner

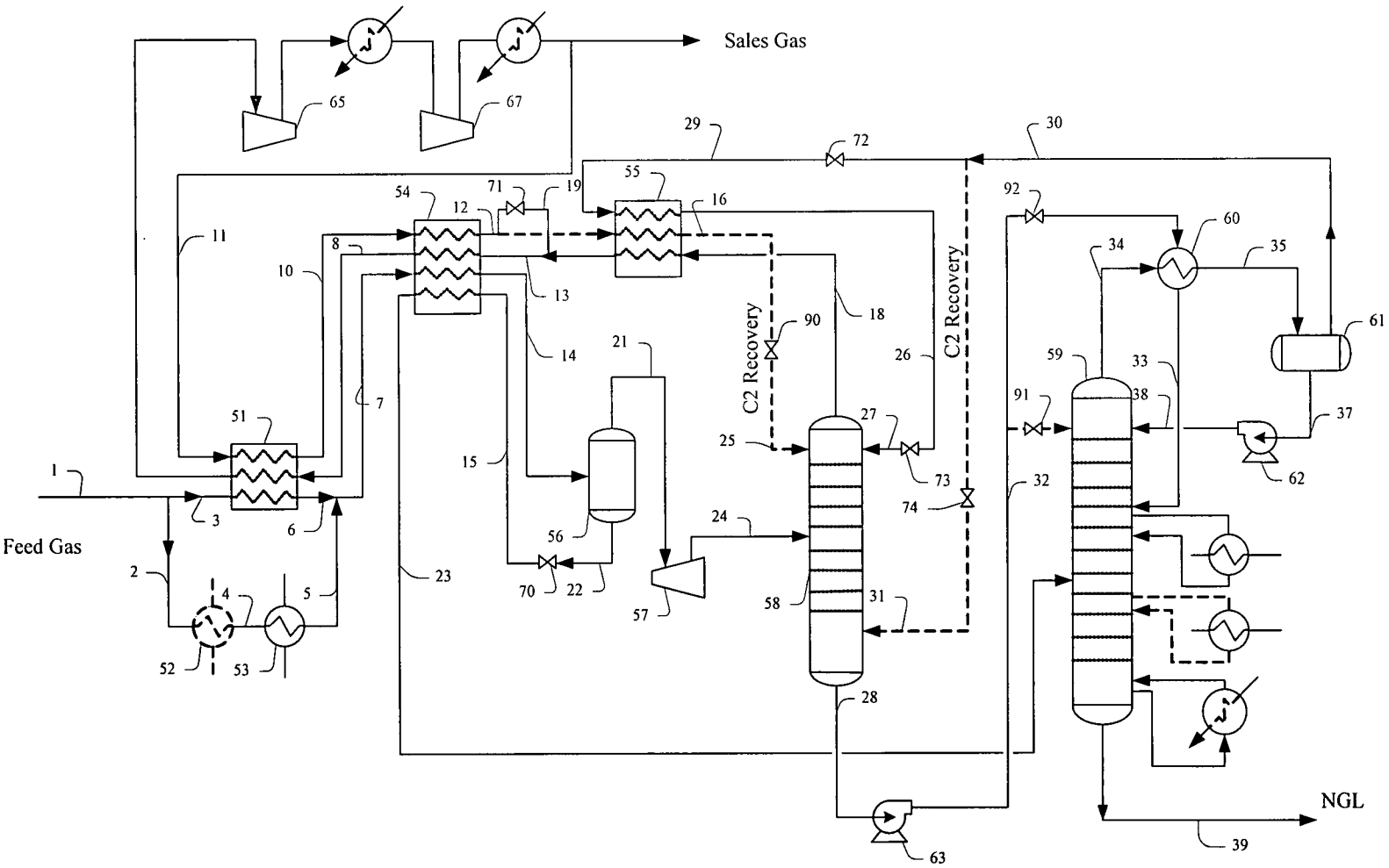
Feed Gas
Sales Gas
NGL
C2 Recovery
C2 Recovery

CONFIGURATIONS AND METHODS FOR IMPROVED NATURAL GAS LIQUIDS RECOVERY

This application claims priority to our U.S. provisional patent application with the Ser. No. 60/955,697, which was filed Aug. 14, 2007.

FIELD OF THE INVENTION

The field of the invention is configurations and methods of processing natural gas, especially as it relates to flexible recovery of natural gas liquids (NGL) from natural gas.

BACKGROUND OF THE INVENTION

Many natural and synthetic gases comprise a variety of different hydrocarbons, and numerous separation processes and configurations are known in the art to produce commercially relevant fractions from such gases. In a typical gas separation process, a feed gas stream under pressure is cooled by a heat exchanger, typically using propane refrigeration when the feed gas is rich (containing more than 5% C3+ components) and as the gas cools, liquids condense from the cooled gas. The liquids are then expanded and fractionated in a distillation column (e.g., de-deethanizer or demethanizer) to separate residual components such as methane, nitrogen and other volatile gases as overhead vapor from the desired C2, C3 and heavier components.

For example, Rambo et al. describe in U.S. Pat. No. 5,890,378 a system in which the absorber is refluxed, in which the deethanizer condenser provides the reflux for both the absorber and the deethanizer while the cooling requirements are met using a turbo expander and propane refrigeration. Here, the absorber and the deethanizer operate at substantially the same pressure. Although Rambo's configuration advantageously reduces capital cost for equipment associated with providing reflux for the absorption section and the de-deethanizer, high ethane recovery of 80% becomes difficult when feed gas pressure is less than 1,000 psig due to lower turbo expansion cooling while reducing absorber pressure. Moreover, where the gas has a high CO2 content (e.g., greater than 2 mole %) expansion cooling is problematic due to the potential of CO2 freezing in the demethanizer. Consequently, such plants typically require deep propane refrigeration which, however, is inherently limited by the temperature level of the refrigerant. Moreover, the propane refrigeration requires additional capital and operating cost and is recognized a safety concern in NGL plants. High ethane recovery of over 80% are rarely achievable with turbo expansion alone and thus propane refrigeration is required, adding complexity and safety hazards particularly in congested offshore and existing facilities environments. To circumvent at least some of the problems associated with relatively low efficiency and low recovery, Sorensen describes in U.S. Pat. No. 5,953,935 a plant configuration in which the absorber reflux is produced by compressing, cooling, and Joule-Thomson expansion of a slipstream of feed gas. Although Sorensen's configuration generally provides improved propane recovery, ethane recovery is typically limited to about 20% to 40%.

In yet other configurations, a turbo-expander is employed to provide cooling of the feed gas for high propane or ethane recovery. Exemplary configurations are described, for example, in U.S. Pat. No. 4,278,457, and U.S. Pat. No. 4,854,955, to Campbell et al., in U.S. Pat. No. 5,953,935 to McDermott et al., in U.S. Pat. No. 6,244,070 to Elliott et al., or in U.S. Pat. No. 5,890,377 to Foglietta. While such configurations may provide at least some advantages over other processes, they typically require modifications of turbo expanders and changes in operating conditions when the plants are changed from propane recovery mode to ethane recovery mode or vice versa, or when the feed gas composition changes over time. These known configurations are typically designed to operate within a narrow range of feed gas compositions and inlet pressures with the use of propane refrigeration. In most cases, high recoveries are also limited by CO2 freezing in the demethanizer, and propane recovery will drop in most cases when operating on ethane rejection mode.

To reduce refrigeration requirements, various configurations are known in which an additional lean reflux stream is routed to the demethanizer as described in WO04065868A2 and WO04080936A1 to Patel. Similarly, Pitman et al. describe in WO2007/001669A2 a plant in which a residue gas recycle stream is employed to control the temperature of the demethanizer for improved ethane recovery. Likewise, Mak et al. (WO2007/014069A2) teach use of a residue gas recycle stream and a lean cold feed gas to allow for increased ethane recovery. Alternatively, as described in U.S. Pat. No. 6,116,050 to Yao, a combined reflux with residue gas and deethanizer overhead is used in the demethanizer overhead, and a dual reflux scheme using residue gas recycle and deethanizer overhead is presented in WO2007/014209A2 to Schroeder et al. While such plants advantageously reduce energy consumption and increase C2 recovery to at least some extent, several disadvantages still remain. Most significantly, all or almost all of those configurations require a relatively fixed feed gas composition and typically lack of operational flexibility where a change in ethane recovery is required.

To circumvent at least some of the problems associated with the lack of flexibility of ethane recovery levels while maintaining high propane recovery, a twin reflux process described in U.S. Pat. No. 7,051,553 to Mak et al. has a configuration in which a first column receives two reflux streams: One reflux stream comprises a vapor portion of the NGL and the other reflux stream comprises a lean reflux provided by the overhead of the second distillation column. While such process is advantageous for varying ethane recovery levels to meet ethane market demand, it nevertheless requires external refrigeration and turbo expansion for feed gas cooling in order to maintain high recovery.

Thus, although various configurations and methods are known to recover natural gas liquids, all or almost all of them suffer from one or more disadvantages. Therefore, there is still a need to provide methods and configurations for improved natural gas liquids recovery.

SUMMARY OF THE INVENTION

The present invention is directed to configurations and methods for NGL recovery from natural gas using a first column that can receive alternate reflux streams, and using a residue gas recycle stream to either form a lean and cold reflux stream or to provide refrigeration for a feed cooler. The overhead product of a second column is then either used as first column feed or as reflux stream. In such configurations and methods, it should be noted that the reflux stream is selected as a function of the desired NGL recovery.

In one preferred aspect of the inventive subject matter, a method of recovering NGL from natural gas includes a step of feeding a vapor portion of a cooled feed gas in a first column to thereby form a first column bottom product and a first column overhead product, and providing alternate first and second reflux streams to the first column. In another step, the first column bottom product is fed to a second column to thereby produce a second column overhead and a second column bottom product, and in yet another step, the first column overhead product is compressed and a portion of the compressed first column overhead product is then expanded. In still another step, expansion of the compressed first column overhead product is used to provide cooling to the feed gas when the second column overhead is used as the second reflux stream, and expansion of the compressed first column overhead product is used to provide cooling to the first column when the portion of the first column overhead product is used as the first reflux. In such methods, it is generally preferred that expansion of the second column overhead product is used to provide cooling to the first column.

In especially preferred methods, the first column overhead product is compressed to pipeline pressure, and it is further preferred that the portion of the compressed first column overhead product is typically between 10% and 50% of the compressed first column overhead product. Moreover, it is generally preferred that the cooled feed gas is cooled using refrigeration content of the first column overhead product and/or a second column reboiler stream, and where desired, further cooling may be provided to the first column by expansion of the vapor portion. Alternatively, or additionally, further cooling may also be provided to the second column by expansion of a liquid portion of the cooled feed gas.

In most aspects of the inventive subject matter, the second column is operated at a pressure that is higher than the operating pressure of the first column, typically at least 10-50 psi, and more typically 20-100 psi higher.

With respect to the recovered NGL it is generally contemplated that the second column bottom product comprises at least 99% of the propane contained in the feed gas and at least 80% of the ethane contained in the feed gas, and/or that ethane recovery in the second column bottom product is variable between 2% and 90% of the ethane contained in the feed gas. Therefore, contemplated second column bottom products will comprise at least 99% of the propane contained in the feed gas, while ethane recovery in the second column bottom product can be variable between 2% and 90% of the ethane contained in the feed gas.

In another aspect of the inventive subject matter, a natural gas liquids recovery plant will typically comprise a first column that is fluidly coupled to a second column such that a first column bottom product is provided to the second column, wherein the first column is configured to allow refluxing using alternate first and second reflux streams. Such plants will further include a compressor that is fluidly coupled to the first column and configured to compress a first column overhead, and further include a bypass conduit that is configured to provide a portion of compressed first column overhead to alternately a feed exchanger or the first column as the first reflux stream. A second conduit is typically included and configured to provide a second column overhead to the first column as (a) a column feed when the portion of the compressed first column overhead is provided to the first column as the first reflux or (b) the second reflux stream when the portion of the compressed first column overhead is provided to the feed exchanger.

It is further preferred that contemplated plants will further comprise one or more side reboilers that are thermally coupled to a feed gas conduit such as to allow cooling of the feed gas. Most typically, a separator is then fluidly coupled to the first column and configured such that the separator produces a vapor portion of a feed gas and a liquid portion of the feed gas. In such plants, it is generally preferred that an expansion device is coupled between the separator and the first column and configured to reduce pressure in the vapor portion and/or the liquid portion. Additionally, it is generally preferred that the bypass conduit includes one or more expansion devices (most typically a JT valve).

With respect to the compressor it is generally preferred that one or more compressors are configured to allow compression of the first column overhead to at least pipeline pressure. Still further contemplated plants will also include a second exchanger that further cools a feed gas using refrigeration content of the first column overhead. As noted above, it is generally preferred that the first column is configured to operate at a first pressure, wherein the second column is configured to operate at a second pressure, and wherein the second pressure is higher than the first pressure. With respect to the bypass conduit it is contemplated that the conduit is preferably configured to allow bypassing of between 10% and 50% of the entire compressed first column overhead product. Such bypass volume will typically allow variable recovery of between 2% and 90% of the ethane contained in the feed gas while maintaining a high recovery of propane (99% and higher).

Various objects, features, aspects and advantages of the present invention will become more apparent from the following detailed description of preferred embodiments of the invention.

BRIEF DESCRIPTION OF THE DRAWING

FIG. 1 is an exemplary configuration of an NGL recovery plant according to the inventive subject matter.

DETAILED DESCRIPTION

The inventor has discovered that high NGL recovery (e.g., at least 99% C3 and at least 90% C2) can be achieved in configurations using chilled residue gas recycle in which the plant is configured such that the first column can receive a reflux stream from one of two locations, wherein the reflux stream is selected as a function of the desired NGL recovery. Advantageously, external refrigeration requirements are entirely eliminated in such configurations, and it should be further recognized that contemplated plants and methods will allow variable ethane recovery levels via switching valves that allow selection of one of the two reflux streams.

Most preferably, contemplated plants and methods employ a two-column NGL recovery configuration having an absorber and a distillation column, and a bypass through which a portion of the residue gas compressor discharge is recycled to thereby eliminate external refrigeration. The absorber is configured to receive two alternate reflux streams, wherein one reflux stream is drawn from an overhead vapor from the column for $C_3$ recovery and wherein the other reflux stream is drawn from the residue gas for $C_2$ recovery. Such plants allow $C_2$ recovery of at least 80% and $C_3$ recovery of at least 99% with the flexibility of varying $C_2$ recovery from 2% to 90% while maintaining 99% $C_3$ recovery. Flexibility is achieved via a first column that receives a reflux stream from residual gas recycle during ethane recovery or a reflux stream from a second column during propane recovery or ethane rejection (in such case, residual gas recycle is used to supplement feed gas cooling via JT operation).

Viewed from a different perspective, it should be recognized that contemplated methods and configurations include a first and a second column utilizing high pressure residue gas recycle to eliminate external refrigeration. In such plants, the first column receives alternate reflux streams, wherein one reflux stream comprises the overhead vapor from the distillation column for C3 recovery, and wherein alternatively the reflux stream comprises a chilled residue recycle gas for C2 recovery. Contemplated configurations are especially advantageous in application to NGL recovery that requires C2 recovery of at least 85% and C3 recovery of at least 99% and flexibility of varying C2 recovery from 2% to 90% while maintaining 99% C3 recovery. Therefore, high NGL recovery is achieved without external refrigeration by using residual gas recycle and a lean reflux stream. During ethane recovery mode, the residual gas is chilled in the overhead exchanger and JT'd to the top tray of the first column while during propane recovery mode, the residual gas is chilled and then JT'd to so provide chilling to the feed gas exchanger.

In one exemplary configuration as depicted in FIG. 1, an NGL recovery plant has a first column 58 that is fluidly coupled to a second column 59. A natural gas feed 1, with a typical composition of 84% C1, 7% C2, 5% C3, 3% CO2 (all numbers in mole percent) and the balance C4+ hydrocarbons enters the NGL plant at about 90° F. and about 1,000 psig and is split into two portions, stream 2 and stream 3. During ethane recovery, stream 2 is cooled in side reboilers 52 and 53 of the second column, forming streams 4 and 5, with stream 5 being about −20° F. Stream 3 is cooled in exchanger 51 using residual gas stream 8 forming stream 6 at about −28° F. to 40° F. During ethane rejection, the available heating duties from the side reboilers are significantly reduced and typically only the upper side reboiler 53 is utilized. Streams 5 and 6 are combined to form stream 7 that is further cooled in heat exchanger 54 forming two phase stream 14 at about 5° F. to −28° F. The condensate is separated in the separator 56 forming liquids stream 22, while vapor stream 21 is expanded in expander 57 to stream 24 at about 450 psig and a temperature of about −60° F. to about −90° F. The power produced from the expander is preferably used to drive re-compressor 65. Liquid stream 22 is letdown in pressure in JT valve 70 forming stream 15 at about 450 psig and about −30° F. to about −50° F. and is fed to exchanger 54 for refrigerant recovery prior to fractionation in the second distillation column via stream 23. It should be noted that the above provided temperature ranges exemplarily demonstrate the operating conditions between ethane recovery and ethane rejection.

In especially preferred configurations, a portion of the residual gas stream 11, typically about 10% (during propane recovery) to 50% (during ethane recovery) of the residual gas flow, is recycled. When processing a lean feed gas and especially at high feed pressure, recycle flow can be significantly reduced or even eliminated. Stream 11 is first chilled with residual gas in exchanger 51 forming stream 10 at about 30° F., then in exchanger 54 to about −30° F. forming stream 12, and for ethane recovery then in exchanger 55 forming stream 16 at about −110° F. During ethane recovery, JT valve 71 is closed and JT valve 90 is open and stream 16 is letdown in pressure in JT valve 90 to about 450 psig forming a lean reflux stream 25 at about −140° F. that is fed to the top tray of the first column. During propane recovery, JT valve 90 is closed, and the chilled recycle gas is letdown in pressure in JT valve 71 forming two phase stream 19 at about 450 psig, which is re-combined with the residual gas from exchanger 55 at about −50° F., which provide chilling to the feed gas in exchanger 54 and 51 via stream 13.

The first column overhead vapor stream 18, typically at about −100° F. to −135°, is used as a refrigerant in chilling the feed gas and the recycle gas in heat exchangers 55, 54, and 51 prior to compression in residue gas re-compressor 65 and residual gas compressor 67. Thus, it should be recognized that the first column overhead vapor cools the recycle gas and that the second column overhead gas and the recycle gas is JT'd to so provide feed gas chilling during propane recovery. Moreover, operation may be switched to ethane recovery by refluxing the first column with the recycled residual gas. In a preferred aspect, switching between ethane recovery and propane recovery is achieved by changing valve positions: Valve 71 is closed and valve 90 is open during ethane recovery, and valve 71 is open and valve 90 is closed during propane recovery. Valve 73 is closed for propane recovery and open for ethane recovery, while valve 74 is closed for propane recovery and open for ethane recovery.

The first column 58 further produces bottoms stream 28, typically at about −100° F. to about −115° F., which is pumped by pump 63 forming stream 32 at about 450 psig. During propane recovery operation, the column bottom stream acts as a refrigerant to provide reflux condensing duty in heat exchanger 60 of the second column, prior to feeding the second column as stream 33. In this operation, valve 91 is closed and valve 92 is open, resulting in partially condensation of the second column overhead stream 34 in condenser 60 to about −35° F., forming stream 35 that is separated in reflux drum 61 into a vapor stream 30 and liquid stream 37. The liquid portion 37 is pumped by reflux pump 62 forming reflux stream 38 to the rectification section of the second column. Second column 59 produces the NGL bottom product 39.

It should be particularly appreciated that contemplated configurations may be used for ethane or propane recovery with repositioning valves. For example, where ethane recovery is required, the condenser 60 can be disabled, and the first column bottom liquid stream 32 is introduced directly to the top tray of the second column by closing valve 92 and opening valve 91, while the overhead vapor from the second column stream 31 (via 34, 35, and 30) is routed directly to the bottom of the first column by opening valve 74.

Where variable ethane recovery is desirable (e.g., from about 2% to about 90%), the flow ratio between flow to the first column top tray and bottom tray of the first column can be varied: Increasing the flow of stream 31 relative to stream 29 via control valves 72 and 74 increases ethane recovery while reducing the relative flows correspondingly reduces ethane recovery. Where stream 30 is used as reflux for the first column (for propane recovery), the reflux is cooled by exchanger 55 against first column overhead product to form stream 26 that is further cooled by JT expansion to stream 27 in JT valve 73.

Thus, it should be noted that during propane recovery, the second column overhead vapor is chilled and partially condensed using the refrigerant content of the first column bottoms producing a vapor and liquid stream. The ethane rich vapor stream is further chilled by the first column overhead forming a reflux to the first column. During ethane recovery, the second column overhead vapor is routed directly to the first column bottom for rectification and recovery of the ethane and heavier components. Preferred NGL recovery operation includes switching valves that permit the changeover from propane recovery mode to ethane recovery mode or vice versa, wherein various ethane recovery levels can be achieved by splitting the second column overhead flow between the first column top tray and the first column bottom tray.

With respect to suitable feed gas streams, it is contemplated that various feed gas streams are appropriate, and especially suitable fed gas streams may include various hydrocarbons of different molecular weight. With respect to the molecular weight of contemplated hydrocarbons, it is generally preferred that the feed gas stream predominantly includes C1-C6 hydrocarbons. However, suitable feed gas streams may additionally comprise acid gases (e.g., carbon dioxide, hydrogen sulfide) and other gaseous components (e.g., hydrogen). Consequently, particularly preferred feed gas streams are natural gas and natural gas liquids.

Thus, it should be especially recognized that in contemplated configurations, the cooling requirements for the first column are at least partially provided by product streams and recycle gas, and that the C2/C3 recovery can be varied by employing a different reflux stream. With respect to the C2 recovery, it is contemplated that such configurations provide at least 85%, more typically at least 88%, and most typically at least 90% recovery, while it is contemplated that C3 recovery will be at least 95%, more typically at least 98%, and most typically at least 99%. Further related configurations, contemplations, and methods are described in our International patent applications with the publication numbers WO 2005/045338 and WO 2007/014069, both of which are incorporated by reference herein.

Thus, specific embodiments and applications for improved natural gas liquids recovery have been disclosed. It should be apparent, however, to those skilled in the art that many more modifications besides those already described are possible without departing from the inventive concepts herein. The inventive subject matter, therefore, is not to be restricted except in the spirit of the present disclosure. Moreover, in interpreting the specification and contemplated claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A method of recovering natural gas liquids from natural gas, the method comprising:

feeding a vapor portion of a cooled feed gas in a first column to thereby form a first column bottom product and a first column overhead product, and configuring the first column to allow feeding of alternate first and second reflux streams to the first column such that the first column receives the first reflux stream during ethane recovery, and such that the first column receives the second reflux stream during propane recovery;

feeding the first column bottom product and a liquid portion of the cooled feed gas to a second column to thereby produce a second column overhead and a second column bottom product;

wherein the first column bottom product is used as a reflux for the second column during ethane recovery and as a refrigerant for an overhead condenser of the second column and second column feed during propane recovery;

compressing the first column overhead product and (a) expanding a portion of the compressed first column overhead product in a first expansion device to thereby form the first reflux stream during ethane recovery, and (b) expanding the portion of the compressed first column overhead product in a second expansion device to thereby provide cooling to the feed gas by combing with the first column overhead product when a portion of the second column overhead is used as the second reflux stream during propane recovery.

2. The method of claim 1 wherein the step of compressing comprises compressing the first column overhead product to pipeline pressure.

3. The method of claim 1 wherein the portion of the compressed first column overhead product is between 10% and 50% of the compressed first column overhead product.

4. The method of claim 1 wherein the cooled feed gas is cooled using refrigeration content of at least one of the first column overhead product and a second column reboiler stream.

5. The method of claim 1 wherein further cooling is provided to the first column by expansion of the vapor portion.

6. The method of claim 1 wherein further cooling is provided to the second column by expansion of a liquid portion of the cooled feed gas.

7. The method of claim 1 wherein the second column is operated at a pressure that is at least 50 psi higher than an operating pressure of the first column.

8. The method of claim 1 wherein the second column bottom product comprises at least 99% of the propane contained in the feed gas and at least 80% of the ethane contained in the feed gas.

9. The method of claim 1 wherein ethane recovery in the second column bottom product is variable between 2% and 90% of the ethane contained in the feed gas.

10. The method of claim 1 wherein the second column bottom product comprises at least 99% of the propane contained in the feed gas, and wherein ethane recovery in the second column bottom product is variable between 2% and 90% of the ethane contained in the feed gas.

11. A natural gas liquids recovery plant comprising:

a first column fluidly coupled to a second column such that a first column bottom product is provided to the second column, wherein the first column is configured to receive a vapor portion of a cooled feed gas and a first reflux stream during ethane recovery and a second reflux stream during propane recovery, and wherein the second column is configured to receive a liquid portion of the cooled feed gas;

a separator that is fluidly coupled to the first column and configured such that the separator produces the vapor portion of the feed gas and the liquid portion of the feed pas;

a first bottom liquid conduit for providing a portion of the first column bottom product to the second column as reflux during ethane recovery and a second bottom liquid conduit for providing a portion of the first column bottom product to an overhead condenser of the second column during propane recovery;

a compressor that is fluidly coupled to the first column and configured to compress a first column overhead;

a bypass conduit that includes a first expansion device and that is configured to provide a portion of expanded compressed first column overhead to a feed exchanger during propane recovery, and a reflux conduit with a second expansion device that is configured to provide a portion of expanded compressed first column overhead to the first column as the first reflux stream during ethane recovery; and a second conduit that is configured to provide a second column overhead to the first column as (a) a column feed when the portion of the expanded compressed first column overhead is provided to the first column as the first reflux or (b) the second reflux stream when the portion of the expanded compressed first column overhead is provided to the feed exchanger.

12. The plant of claim 11 further comprising a side reboiler that is thermally coupled to a feed gas conduit such as to allow cooling of a feed gas.

13. The plant of claim 11 further comprising an expansion device fluidly coupled between the separator and the first column and configured to reduce pressure in at least one of the vapor portion and the liquid portion.

14. The plant of claim 11 wherein the compressor is configured to allow compression of the first column overhead to pipeline pressure.

15. The plant of claim 11 further comprising a second exchanger that further cools a feed gas using refrigeration content of the first column overhead.

16. The plant of claim 11 wherein the first column is configured to operate at a first pressure, wherein the second column is configured to operate at a second pressure, and wherein the second pressure is higher than the first pressure.

17. The plant of claim 11 wherein the bypass conduit is configured to allow conveying of between 10% and 50% of the compressed first column overhead product.

18. The plant of claim 11 wherein the plant is configured to allow variable recovery of between 2% and 90% of the ethane contained in the feed gas.

* * * * *